United States Patent [19]

Phillips

[11] 4,255,651

[45] Mar. 10, 1981

[54] SHEET COUNTING METHOD AND APPARATUS

[75] Inventor: Christopher A. P. Phillips, Fareham, England

[73] Assignee: De La Rue Systems Limited, London, England

[21] Appl. No.: 75,203

[22] Filed: Sep. 12, 1979

[30] Foreign Application Priority Data

Sep. 15, 1978 [GB] United Kingdom ..... 36968/78

[51] Int. Cl.[3] ..... G06M 7/06

[52] U.S. Cl. ..... 235/92 SB; 235/92 DN; 235/92 FP

[58] Field of Search ..... 235/92 SB, 92 FP, 92 DN, 235/92 PE, 98 R, 98 B; 271/263; 209/534

[56] References Cited

U.S. PATENT DOCUMENTS

| | | | |
|---|---|---|---|
| 3,778,051 | 12/1973 | Allen et al. | 235/92 SB |
| 3,930,582 | 1/1976 | Gartner et al. | 235/92 SB |
| 4,072,854 | 2/1978 | Oshima et al. | 235/92 SB |
| 4,179,031 | 12/1979 | Ward | 209/534 |

*Primary Examiner*—Joseph M. Thesz
*Attorney, Agent, or Firm*—Martin Novack

[57] ABSTRACT

A method of counting a succession of sheets passing along a flow line (the sheets being normally spaced but including some overlapping sheets), comprises determining the position of a double thickness in relation to the total length of the sheet in the flow direction. A count of two is added to the count of sheets if the double thickness is found to be symmetrically placed in relation to the total length of the sensed "sheet" and has a length consistent with the amount by which two single sheets would have to overlap to have a total length equal to the sensed "sheet" length. If these requirements are not met, depending on the results of the measurements either a count of one is added or an error signal is generated.

10 Claims, 5 Drawing Figures

Figure 1:
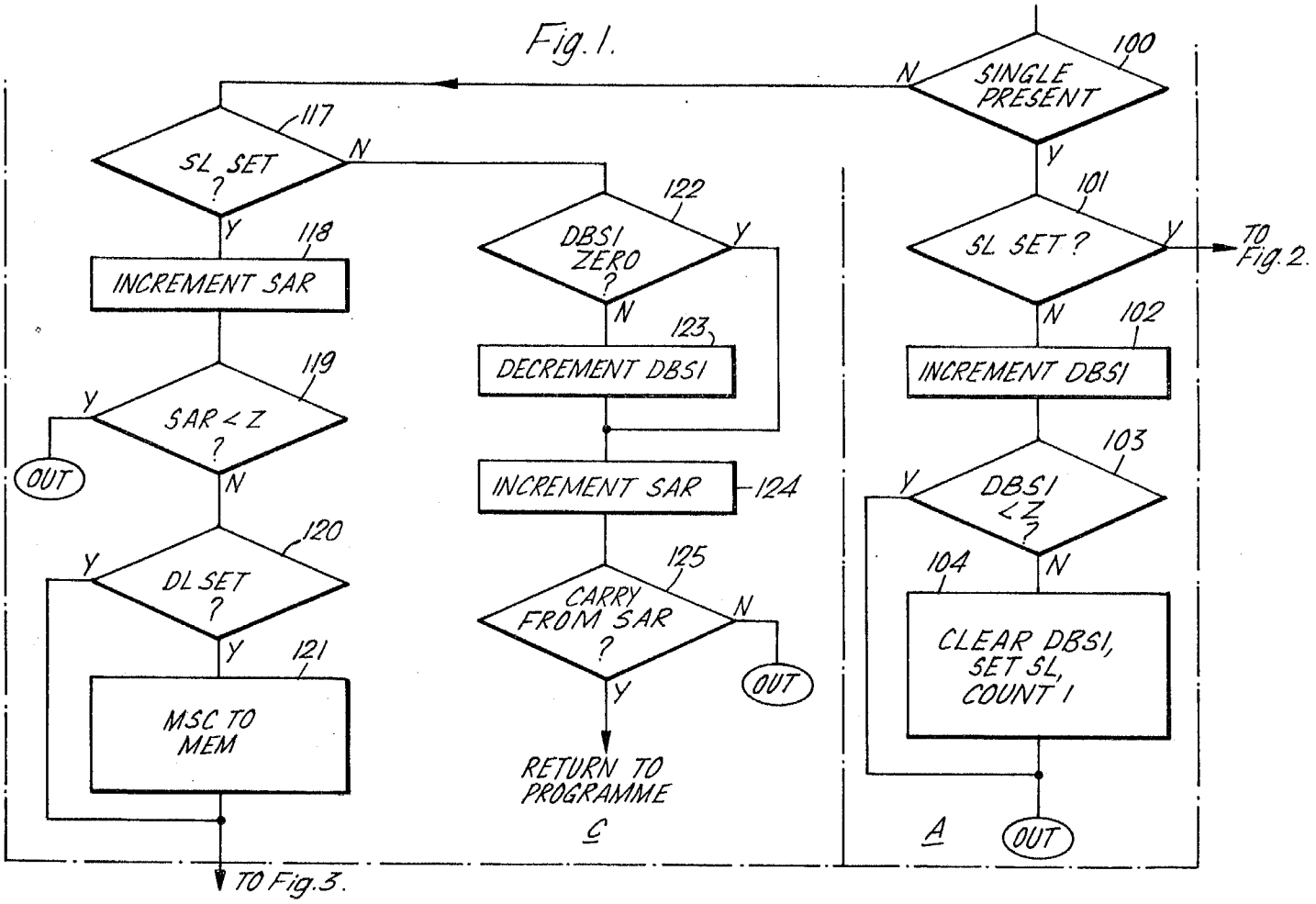

FROM Fig. 1.
INCREMENT MSC
105
DOUBLE PRESENT ?
106
INCREMENT TDC
107
DL SET ?
108
INCREMENT DBD1
109
DBD1 < Z ?
110
SET DL MSC TO MEM
111
OUT
CLEAR DBD1
116
OUT
DL SET ?
112
INCREMENT DBD2
113
DBD2 < Z ?
114
CLEAR DL, MSC TO MEM, CLEAR DBD2
115
Y
N

+5V
0V
SINGLES SENSOR
DOUBLES SENSOR
DEBOUNCE
DEBOUNCE
CLOCK
MSC
TDC
PREVIOUS SINGLES COUNTER
SEQUENCER
ARITHMETIC & COMPARISON UNIT
COUNT ONE
+ EXTRA COUNT
TOTALISER
NOTE COUNTER UNIT
COMPARATOR
BATCH STORE
DISPLAY TOTAL
CLEAR
MACHINE CONTROL UNIT
DRIVER
DRIVER
DRIVER
DISPLAY
CLUTCH
MOTOR
DEMULTIPLEXER
MEMORY STACK
D1 ON
D1 OFF
D2 ON
CONTROL & DECODER

SHEET COUNTING METHOD AND APPARATUS

This invention relates to a sheet counting method and apparatus for counting sheets fed in spaced relationship along a flow-line to a delivery station.

Whilst the invention has particular relevance to apparatus for handling sheets of monetary value, for example banknotes, it also has utility in relation to other sheets which are required to be handled with a similar degree of accuracy.

Although many counting machines and their associated feeders are capable of handling banknotes with a high degree of efficiency, it is necessary to make provision for certain conditions of the notes which may give rise to misfeeds or miscounts. For example, banknotes may adhere together in either partially or wholly overlapping relationship and be capable of being moved through the apparatus and counted as one note; the passage of such "doubles" may readily be detected for example by devices for sensing variations in thickness or opacity and these devices may be employed to operate a mechanism which diverts "doubles" from the flow-line and this prevents them from being counted and from reaching the delivery station.

However, in the interests of economy in price and the size of relevant machines it is desirable not to divert doubles but to provide for the recognition of certain "doubles" as two notes, and for these to be so recorded in a counter and to reach the delivery station. This invention has for its object to provide a machine in which many overlapping notes fed from a supply stack reach the delivery station and are counted as two notes without interrupting the operation of the machine; certain other overlapping sheet combinations cannot be counted during the normal operational cycle of the machine.

In accordance with the present invention, a method of counting sheets of a given length and of a given thickness in a succession of spaced single sheets and overlapping sheet combinations passing along a flow-line, comprises: sensing the beginning and end of a sheet, or combination of overlapping sheets, travelling along the flow-line to ascertain a sensed length therefor; detecting any increased thickness in the sensed sheet or sheet combination and storing the positions of the beginning and end of such increased thickness in relation to the sensed length of the sheet or sheet combination under evaluation; automatically testing to ascertain whether a detected increased thickness is substantially symmetrically placed about the mid-point of the sensed length in the direction of the flow-line and has a length not substantially less than the amount by which two sheets of the given sheet length would have to overlap to have a total length equal to the said sensed length; and adding two to the count of sheets if the result of the said test is positive.

Thus, when a note having a folded extremity which will simulate a "doubles" condition, passes through the machine, the double thickness will be detected over the area of the fold but the note will be counted as a single note without interruption to the operation of the machine. Similarly, the presence of any small piece of adhesive mending tape on a banknote, which is so placed as to influence the detection system, will not prevent the counting of such a repaired note as a single note.

The "given" length of a standard single sheet may be determined initially as the length of a first sheet in the batch to be counted and thereafter as the length of any single thickness sheet which is found to be shorter than the previous standard. This facility for self-determination of standard sheet length has the advantage that the machine needs no pre-adjustment when sheets of different sizes are counted in successive operations. Preferably the values obtained for at least the first sheet of a batch are retained in store until the second has passed by the sensor, so that if the first sheet is a double, an extra count may be added in respect of this first composite sheet after the passage of the second sheet, and following calculations based on the stored values for the composite sheet and on the "given" length established by means of the single-thickness second sheet.

The measurement of the length of notes may be carried out by regular sampling of the state of a sensor past which the note travels at uniform speed along the flow line; the note length is proportional to the number of successive samples which show the presence of a note.

Preferably a sensed "sheet" which does not meet the test to be counted as two sheets and does not consist of wholly or substantially overlapping sheets will also cause the machine to abort if the sensed length exceeds a given multiple of the given length of the standard single sheet.

In the preferred form, when two sheets overlap and their total length is known, by finding the difference between the total length and the stored length of a standard single sheet a value is determined for the non-overlapped parts of the sheets; if this value is subtracted from the length of the standard single note, a value for the overlap is obtained and the position of such overlap symmetrically about the centre-line of the overlapped sheets can be calculated. A detected "sheet" is counted as two sheets only when the position of the detected double thickness does not conflict with the result of the above-mentioned calculation.

Preferably wholly superposed sheets and partially overlapping sheets having an overlap portion which represents a high proportion of the overall length of the composite are not counted as two sheets but instead result in an error signal. The "error" signal may be used to operate indicating, actuating or recording means and may, for example, cause an interruption of the machine cycle. Tests for such overlapping sheets are advantageously carried out prior to the test for symmetrical overlap.

The invention also relates to a machine for carrying out the method according to the invention. Such a machine is capable of recognising and counting as two sheets a very high proportion of the overlapped sheets which are found in practice. Of course, it will not work satisfactorily in all conditions; for example, an unacceptable result would be obtained in the unlikely event that the whole or a substantial part of the feed comprised superposed double sheets. The risk of malfunction is much reduced.

The means for determining sheet thicknesses may be of any known kind but we prefer to use two sets of electrical contacts which are normally closed, the first set being opened upon the passage of a sheet of normal thickness, and the second (with the first remaining open) upon the passage of any portion having the greater thickness of a double or folded sheet. Conveniently detection is accomplished by a gauging nip formed by fixed and movable axis rollers and the movement of the latter operates the contacts via an amplified lever system.

In the preferred arrangement, the electrical contacts are continually interrogated by a real time clock, for example, a quartz crystal clock. As the sheet moves along the flow line at a substantially constant speed, the sampling of the contacts at predetermined time intervals directly gives information corresponding to a given increment of sheet length.

The processing of the interrogation signals may be accomplished by a suitable arrangement of binary bit registers which are used in known manner to count and store relevant information, by logic gates and by known arithmetic comparison circuits and electronic accumulators arranged to make necessary comparisons, calculations and decisions in accordance with relevant stored information. These may be incorporated in a microprocessor.

It is convenient to store the lengths of only a limited number of the theoretically large number of variations of greater thickness which might occur (for example, if the sensors found many separate pieces of mending tape on a sheet), the said limited number being related to the general efficiency of the system and its ability to distinguish between sheets on the basis of such limited information.

The machine may be used as a simple counter or to deliver predetermined batch quantities; the batch requirements may conveniently be conveyed to the processor and integrated with its overall operations. On batch operations a warning is preferably given if insufficient sheets are fed (due perhaps to the emptying of the supply stack) of if too many notes are fed, such as for example, if the last note fed qualified for being counted as two notes.

Figure 2:
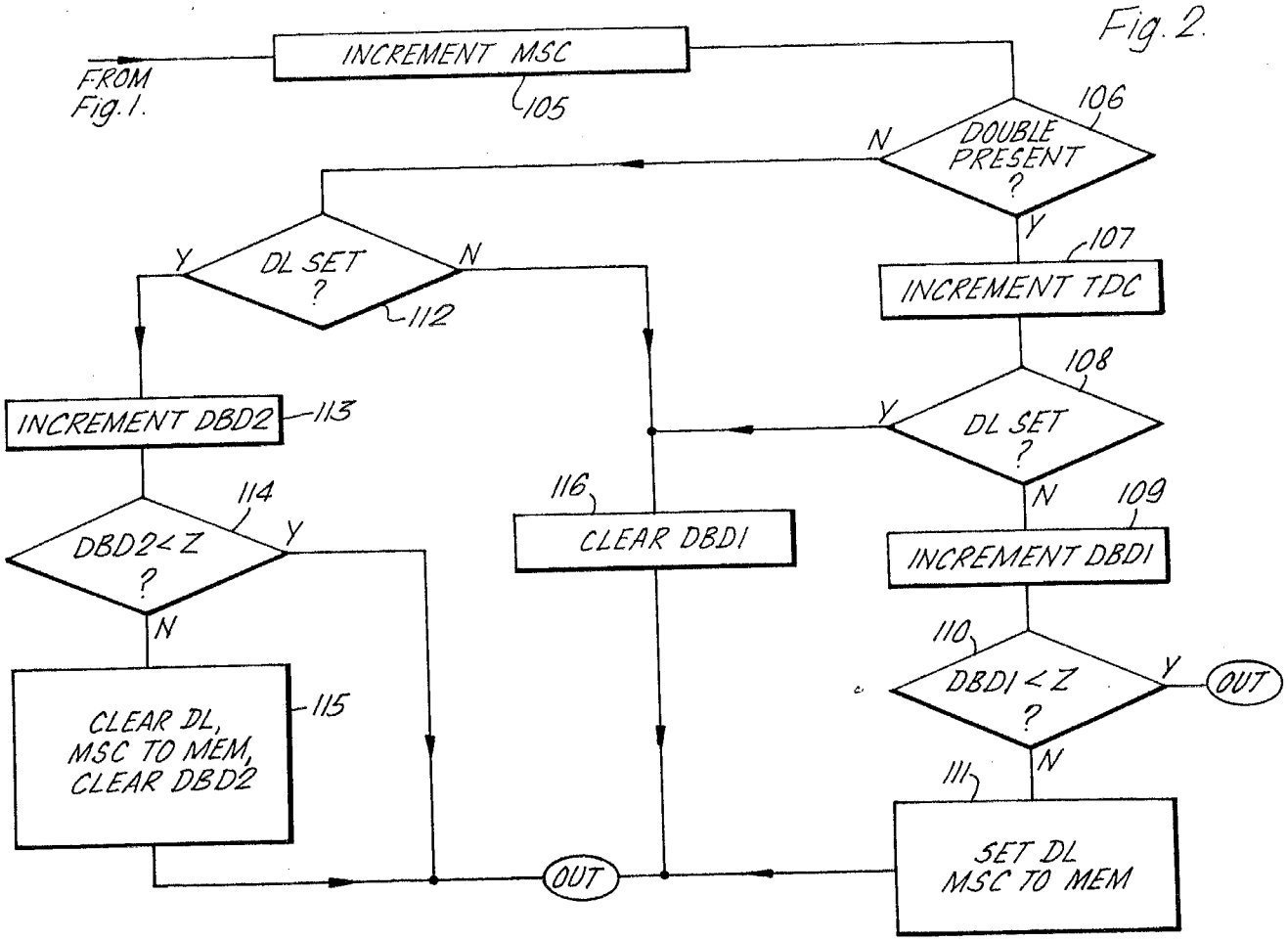
Figure 3:
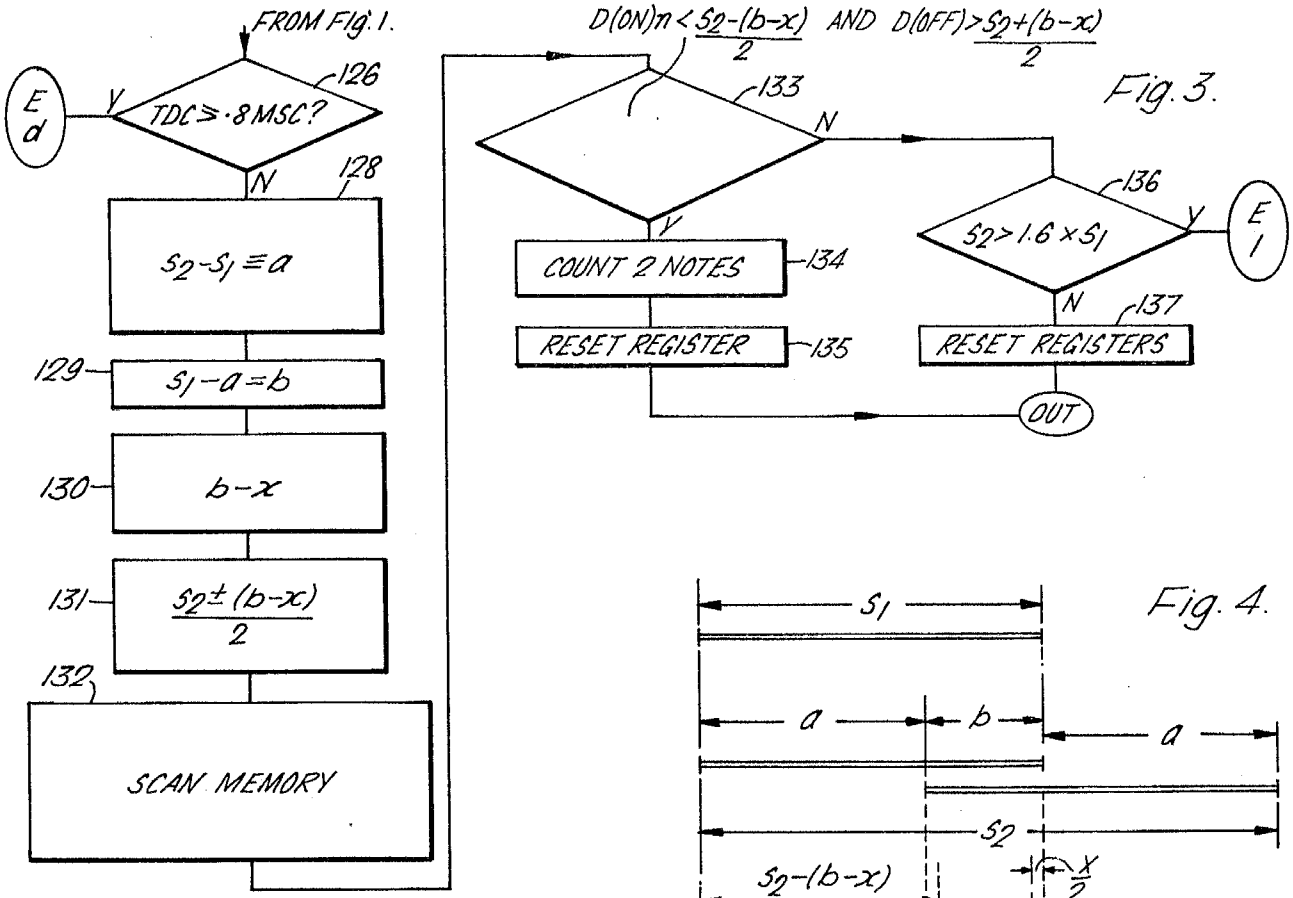
Figure 4:
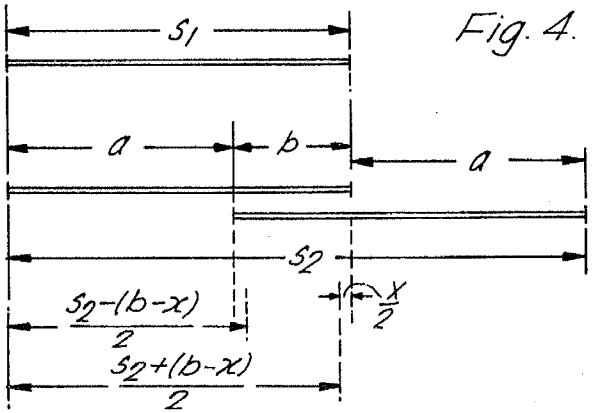
Figure 5:
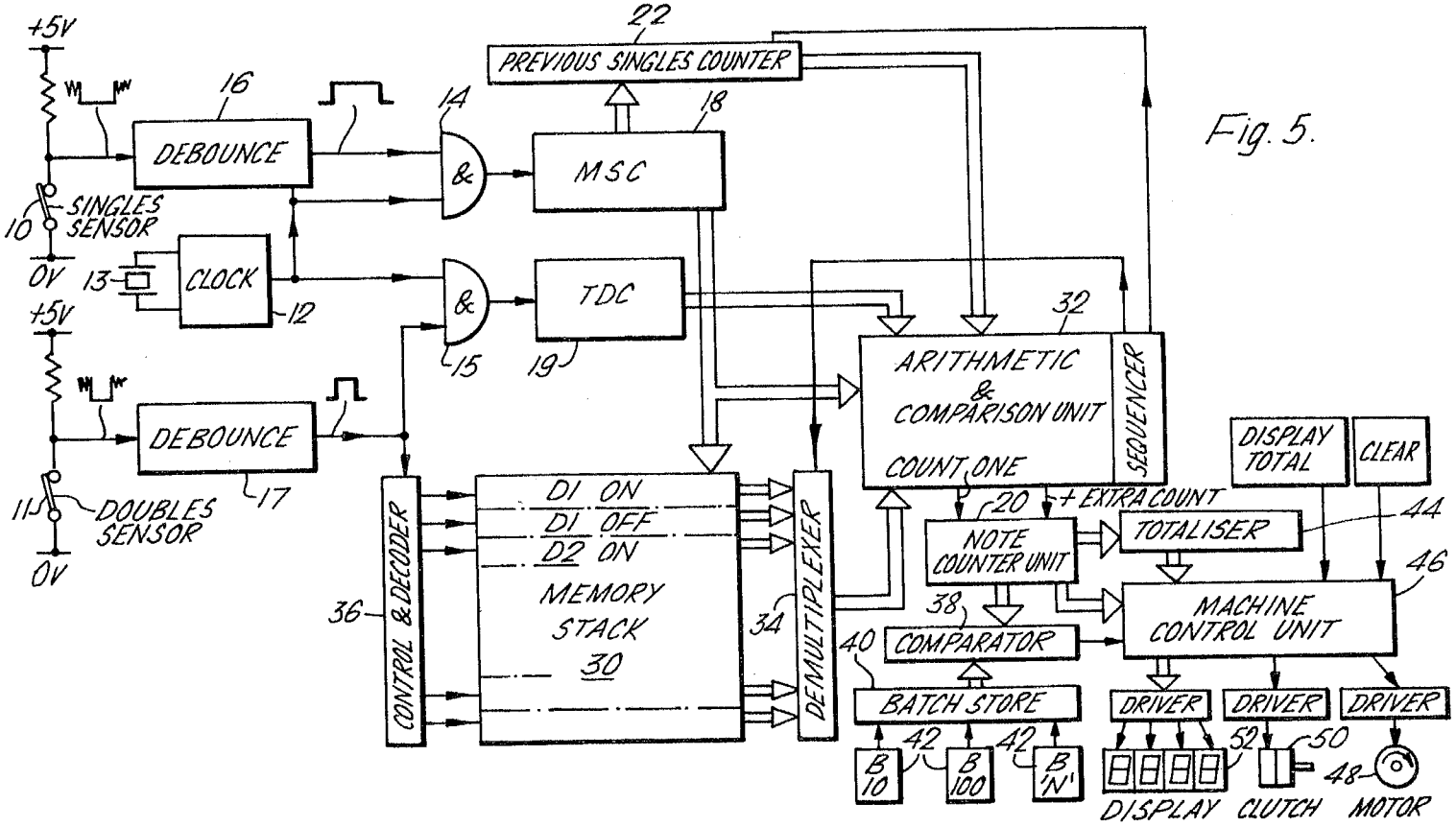

One embodiment of the invention, as applied to a machine for counting and batching banknotes, will be described with reference to the accompanying drawings in which:

FIGS. 1 to 3 collectively represent a flow chart for the logic of a control system suitable for use in the implementation of the invention;

FIG. 4 is a diagrammatic representation of an edge view of a single banknote and a pair of partially overlapping banknotes; and FIG. 5 is a block diagram of the electric and electronic elements of the machine.

The system described in this example relies essentially upon the regular periodic interrogation of sheet-sensor controls and the analysis of the results of such interrogation by the logic of an electric control circuit. Two sensors 10 and 11 (FIG. 5) are employed, a singles sensor to determine the passage of a single banknote and a doubles sensor to detect the passage of banknotes having a plural thickness (which may be wholly or partially overlapping banknotes, banknotes with folded edges and tape-repaired banknotes); the sensors may be of any kind, for example, optical, mechanical or electrical.

Banknotes are fed from a supply stack along a flow line at a constant velocity with their long edges perpendicular to the direction of movement along the flow line. The driving apparatus is of a known kind and includes a friction clutch. The sensors are located away from the axis of the flow line to avoid creases along the centre of the banknotes. A clock 12 (FIG. 5) controlled by a quartz crystal oscillator 13 generates a train of pulses which sample the state of the sheet sensors every ½ millisecond to determine whether banknotes of single or plural thickness (as defined above) are passing. Additionally, the velocity of the flow line being constant, these pulses are used in conjunction with a gating system and pulse counting means to develop and store signals indicative of lengths.

The registers referred to in connection with FIGS. 1 to 3 and the counters shown in FIG. 5 are 8-bit binary registers and the "latches" referred to in the flow diagram (FIG. 1) are represented by the state (on/off) of one bit of an appropriate register (see below). In FIG. 5 these latches are represented as "and" gates 14 and 15.

The dotted lines which divide FIG. 1 into two areas A and C are included solely as an aid to description. These areas and the part of the flow chart in FIG. 2 include references to the debouncing of signals which arise at the opening and closing of the sensor contacts. This debouncing, which effectively makes allowance for and cancels out spurious signals arising from the juddering of the contacts as they open and close, forms no part of the invention as such; suitable debounce circuits (shown as 16 and 17 in FIG. 5) are known per se and are commercially available and, depending upon the nature of the sensors employed, it may or may not be necessary to debounce the signals in order to obtain the precise waveform which the system ideally requires.

In the flow diagram, for economy of space the following abbreviations are used:

SL
Singles Latch
DL
Doubles Latch
DBS1
Debounce-singles register
DBD1, DBD2
Debounce-doubles registers
MEM
Memory stack
MSC
Master singles counter
TDC
Total doubles counter
SAR
Singles absent register The first question to be asked and answered every 0.5 milliseconds is whether or not a banknote is present. This is represented in FIG. 1 by the "single present" step 100 in the flow diagram and the answer is obtained by interrogation of the singles sensor 10 (FIG. 5).

Assuming that the singles sensor 10 is open, i.e. a sheet is present, the "YES" route (indicated by Y) is followed in the flow diagram. Consequently, considering area A of FIG. 1 the next step 101 is to ascertain whether or not the singles latch is set. If the singles latch is not set the NO line (indicated by N) is followed from step 101 and a debounce-singles register DBS1 is incremented in step 102. This occurs at each interrogation until the value in the debounce-singles register exceeds a predetermined value "Z" (step 103) which is precalculated to be adequate to cover the period of the desired square-wave signal; if the value is less than "Z" the result of the next interrogation is awaited and this is denoted by the word "OUT". When on the other hand the value exceeds "Z", in a stage 104 the debounce singles register will be cleared, the singles latch will be set and a count of one will be recorded on the note counter unit 20 (FIG. 5). It is to be noted here that the recordal of the passage of one note occurs immediately after the signals arising from the opening of the contacts have been debounced and is unrelated to the passage of a sheet completely through the contacts. This is important for the case in which the banknote completes the batch count, as it ensures that the note is counted, and that a signal to interrupt the feed is generated, at the earliest possible moment.

FIG. 2 follows the logic from any point where with a single present the answer to the question "SINGLES LATCH SET?" (step 101) is in the affirmative. Upon the setting of the singles latch a master singles counter 18 (FIG. 5) is incremented (step 105) and keeps a count of the number of interrogations for which the singles latch is set; it is in effect a length counter for the detected sheet. Upon each interrogation the question "DOUBLE PRESENT?" is also asked (step 106); if the answer is "yes" the total doubles counter 19 (FIG. 5) is incremented (step 107) and the question "DOUBLES LATCH SET?" is asked (step 108). The total doubles counter is also a length counter. If the doubles latch is not set, debouncing is required and the "debounce-doubles" register DBD1 is incremented (step 109). When the value in the register exceeds the value "Z" as ascertained in step 110, the doubles latch is set in a step 111 and the value in the master singles counter which corresponds to the position of the leading edge of the double along the length of the banknote is loaded into the next available register in the memory stack 30 (FIG. 5), thus to record a value for "$D_1$ON". As indicated by the word "OUT" the logic circuitry continues to await instructions arising from the next succeeding interrogation.

If, on the other hand the answer to the question "DOUBLE PRESENT?" is in the negative it is then necessary to ascertain if the doubles latch is set (step 112). If it is, it indicates that the end of a double portion of a note has just moved by the sensor and the arising signals are debounced by the incrementation of the doubles-debounce register DBD2 (step 113) until the value thereof exceeds "Z" (step 114); when that value is exceeded the doubles latch is cleared in a stage 115 and at the same time the value in the master singles counter corresponding to the position along the sheet at which the double ceased is loaded into the next available register in the memory stack 30, thus to record a value for "$D_1$OFF". This value is associated with the aforesaid value of $D_1$ON. Until the value of the doubles-debounce register DBD2 exceeds Z the logic awaits the result of the next interrogation as indicated by "OUT".

In either of the circumstances of (1) DOUBLE PRESENT and DOUBLES LATCH SET or (2) NO DOUBLE PRESENT and DOUBLES LATCH unset the double-debounce register DBD1 is cleared (step 116) thus to ensure that this register is always available for incrementation upon the passage of a double or upon the passage of the next succeeding double following the loading into the master singles register of a value corresponding to the position of a double along the length of a banknote. In either instance, as denoted by "OUT" the logic then awaits the result of the next interrogation.

Returning now to the initial question "SINGLE PRESENT?" and with a negative answer, reference is made to area C (FIG. 1). If the singles latch is found to be set (step 117), this indicates that the sensors have detected a break in the continuity of a note, the presence of which caused the setting of the singles latch, or that a note, the presence of which had been confirmed immediately previously, has now left the sensors; the singles-absent register is then incremented (step 118) until enquiry indicates that its value exceeds "Z" (step 119) and then, if the doubles latch is not set, as ascertained in step 120, the completion of the debouncing of this "OFF" signal indicates that a sheet has passed completely by the sensors. The resulting signals are then analysed (see FIG. 3 below). If, on the other hand, the doubles latch is set, the presence of a double at the end of a sheet is indicated. The value in the master singles counter when the singles-absent register exceeds "Z" is loaded into the next available register in the memory stack (FIG. 5) in step 121 thus to record the position, along the length of the note, of the end of the double, the recording being delayed to match the delay in the recording of the position of the commencement of this double as described in FIG. 2.

If with no single present the singles latch is not set, the interrogation requires it to be determined whether or not the debounce singles register DBS1 is zero (step 122); if it is not it is decremented (step 123) upon the present and successive interrogations until it reaches that level. The singles-absent register is then incremented (step 124) and the system awaits the next interrogation if there is no "carry" from the singles-absent register (step 125); if there is a "carry" the machine stops and the display 21 (FIG. 5) flashes to indicate a fault condition, i.e. an excessive interval between sheets.

FIG. 3 relates to the analysis carried out by the logic to determine whether or not the amount of double and its placement in relation to the overall "length" of the note in the flow direction is such that the sensing of two overlapped notes may result in the recognition of the composite as two standard notes and the addition of a further increment of count to the note counter unit 20 (FIG. 5). Additionally the logic of FIG. 3 determines whether, with the amount of double and its placement not producing the said additional count, the sheet should properly have been recognised as one sheet. If the analysis shows either a double incorrectly placed or a double correctly placed but of insufficient length in relation to the overall length of the note it is necessary to determine whether the amount and placement of the double may be tolerated for a count of 1 sheet to be recorded, or whether an error signal must be generated. When the overall length of the composite exceeds a predetermined value, we rely on the presence of a predetermined amount of double about the centre line of the sheet for the addition of an extra unit of count and any greater amount of double (for example, two completely superposed sheets) results in the creation of an error signal and the stopping of the machine.

By way of further description, the length of a standard note is determined and updated by the logic so that, referring now to FIG. 4, S1 (the length of a standard note) is the length of the shortest note processed by the machine; S2 is a double note with symmetrical central overlap; "b" is the length of the overlap in the flow direction; and "a" is equal to the length of (S1-b).

After a sheet has passed the sensors 10 and 11 and the signals therefrom have been debounced, a count of 1 having been recorded as described in connection with Section A, the logic enquires in step 126 of the flow diagram (FIG. 3) whether for that sheet, the value 0.8 multiplied by the value in the master singles counter is less than, or equal to, the value in the total doubles counter i.e. whether the doubles length is greater than or equal to four-fifths of the total length recorded in the master singles counter; if it is, an error signal is generated and the machine stops.

If it is not (line N from 126), the difference between the master singles counter value S2 and the value S1 in the previous-singles counter 22 (FIG. 5) is calculated in step 128. In other words, a value "a" (S2-S1) is calculated and the value "a" is subtracted from S1 (step 129) to give a value "b" which, for overlapping sheets, represents the length of the overlap. A small predetermined tolerance error "x" is then subtracted from "b" (step 130) and two values $$\frac{S2-(b-x)}{2} \text{ and } \frac{S2+(b-x)}{2}$$

are calculated in step 131; these values give the position of the double about the centre-line of the composite note. The memory stack 30 which holds the position of the Doubles-On and Doubles-Off signals representative of the position of doubles on the note undergoing analysis is then scanned (step 132) to determine whether it contains a Doubles-On value less than $$\frac{S2-(b-x)}{2}$$

and a Doubles-Off value greater than $$\frac{S2+(b-x)}{2}.$$

If both values are found (step 133) an extra count of 1 is added (step 134) to the note counter unit 20 (FIG. 5). The master singles counter 18 and the total doubles counter 19 are reset. The logic then awaits the results of the next interrogation of the sensors 10 and 11.

It will be appreciated that this test not only determines whether there is a symmetrical overlap but also excludes sheets exhibiting a double thickness of too small a length, having regard to the length represented by the count in the master singles counter, to be the overlap of two overlapping sheets of standard length. For example, if a single sheet has been repaired with adhesive tape which is symmetrically placed in relation to the "length" of the sheet in the flow direction and is much smaller than this sheet "length", the value "a" obtained by substracting S1 from S2 is small; in fact it is zero if the length of the sheet under evaluation is equal to the given length. Consequently, the value "b" obtained by subtracting "a" from S1 and the value (b−x) are very large. Then $$\frac{S2-(b-x)}{2} \text{ and } \frac{S2+(b-x)}{2}$$

will define points close to the leading and trailing edges of the sheet and the positions of the beginning and end of the double thickness in the repaired sheet do not meet the requirements of step 133 in the flow diagram.

If the said values are not found upon the scanning of the memory stack 30 the next question (step 136) to be determined by the logic is whether or not the length of the sheet analysis exceeds 1.6 multiplied by the length stored in the previous-singles counter 22 (see below). If that value is exceeded, the machine stops and an error signal is displayed. If that condition is not detected the master singles counter 18 and the total doubles counter 19 are reset, the count of 1 attained in Section A remains and the logic awaits the results of the next following interrogation.

The value 1.6 is selected to permit the passage of notes which are skewed with respect to the flow line (it will be remembered that ideally the long edges of the notes are perpendicular to the flow line). The ratio of the dimensions of the note are also taken into account in determining the value 1.6.

The previous-singles counter 22 is loaded with the value in the master singles counter 18 upon the clearing of the first note through the system; this establishes a perhaps temporary datum for the length of a single note. If any shorter note of single thickness throughout its length is subsequently recorded in the master singles counter this value is transferred to the previous-singles counter and the value that was in that counter is discarded.

Turning now to FIG. 5, the operation of the apparatus shown has been in part described with reference to the flow diagram. The arithmetic and comparison unit 32 carries out a number of arithmetic and comparison functions, including comparing the value in the previous-singles counter 22 with that in the master singles counter 18 for the purpose of updating the value in the previous-singles counter if the value in the master singles counter is smaller, as described above. It also carries out the arithmetic operations required in the analysis section of the flow diagram in FIG. 3, receiving values from the memory stack through the demultiplexer 34. Inputs to the memory stack are effected through the control and decoder unit 36.

For batching operations, a comparator 38 compares the output of the note counter unit 20 with a number set into a batch store 40 by one of the batch number controls 42. When the required batch is complete the feed of further notes is interrupted by means of the friction clutch, although the conveyor rolls continue to direct the notes on the flow line to their destination. A totaliser 44 keeps a count of the total number of sheets which have been batched. A machine control unit 46 controls the operation of a motor 48 and clutch 50, and also the operation of a display 52.

In practice, the counters, memory, arithmetic and comparison units of FIG. 5 are preferably incorporated in a dedicated microprocessor such as the MK 3870, supplied by MOSTEK, suitably dedicated to carry out these operations.

I claim:

1. A method of counting sheets of given length and of a given thickness in a succession of spaced single sheets and overlapping sheet combinations passing along a flow-line, comprising the steps of:

sensing the beginning and end of a sheet, or combination of overlapping sheets, travelling along the flow-line to ascertain a sensed length therefor;

detecting any increased thickness in the sensed sheet or sheet combination and storing the positions of the beginning and end of such increased thickness in relation to the sensed length of the sheet or sheet combination under evaluation;

automatically testing to ascertain whether a detected increased thickness is substantially symmetrically placed about the mid-point of the sensed length in the direction of the flow-line and has a length not substantially less than the amount by which two sheets of the given sheet length would have to overlap to have a total length equal to the said sensed length;

and adding two to the count of sheets if the result of the said test is positive.

2. A method in accordance with claim 1, further comprising generating an error signal if the detected increased thickness has a length, in the direction of movement along the flow-line, which is equal to or nearly equal to the given length.

3. A method in accordance with claim 1 or 2, in which the sheet length is ascertained by placing a sensor so that it detects the presence of a sheet passing at a uniform speed along the flow line, sampling the sensor at regular intervals, and counting the number of successive samples which indicate the presence of the sheet.

4. A method in accordance with claim 1, in which a count of 1 is recorded as soon as each sheet or overlapping sheet combination is detected by the sensor, and an additional count is recorded if the result of the said test is positive.

5. A method in accordance with claim 4, in which when the count reaches a predetermined number the passage of further sheets along the flow line is interrupted.

6. A sheet counting machine for counting sheets of a given length and of a given thickness in a succession of spaced single sheets and overlapping sheet combinations passing along a flow line, comprising:

means for sensing the beginning and end of a sheet or combination of overlapping sheets passing along a flow line to ascertain a sensed length therefor;

means for detecting portions of the sheet or overlapping sheet combination which have a thickness greater than that of a single sheet and for storing the position of the portion of greater thickness in relation to the said sensed length of the sheet or overlapping sheet combination;

means for testing whether a detected increased thickness is substantially symmetrically placed about the mid-point of the sensed length in the direction of the flow line and is of a length not substantially less than the amount by which two sheets of the given sheet length would have to overlap to have a total length equal to the said sensed length;

and means for adding two to the count of sheets in responsed to a positive output from the said testing means.

7. A sheet counting machine in accordance with claim 6, further including means for causing the machine to produce an error signal when the passage of wholly overlapped sheets is detected.

8. A machine in accordance with claim 7, in which the error signal is produced when the portion of increased thickness is longer than 4/5ths of the said given sheet length.

9. A machine in accordance with claim 6 or 7, in which the given length of a sheet in a batch of sheets to be counted is replaced by the length of a sensed sheet if the sensed sheet is shorter than the previous value for the given sheet length.

10. A machine in accordance with claim 6 or 7, comprising means responsive to the detection of the leading edge of a sheet or overlapping sheet combination to add 1 to the count of sheets, and for adding an additional count if the result of the said test is positive, and further comprising means responsive to a count representative of the passage of a required number of sheets for generating a signal to interrupt the feed of further sheets, whereby the feed-interrupting signal is given as soon as the last of the required number of sheets reaches the detection means.

* * * * *